US006889878B2

(12) United States Patent
Parsons

(10) Patent No.: US 6,889,878 B2
(45) Date of Patent: May 10, 2005

(54) BATON CARRIER

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 466 days.

(21) Appl. No.: 10/010,543

(22) Filed: Nov. 8, 2001

(65) Prior Publication Data

US 2003/0085244 A1 May 8, 2003

(51) Int. Cl.[7] ..... F16M 13/00

(52) U.S. Cl. ..... 224/200; 224/197; 224/245; 224/251; 224/678; 224/914; 224/915; 248/514; 248/521

(58) Field of Search ..... 224/197, 198, 224/200, 245, 251, 678, 679, 680, 911, 914, 915; 135/16; 248/514, 521, 534, 535

(56) References Cited

U.S. PATENT DOCUMENTS

| | | | | | |
|---|---|---|---|---|---|
| 2,783,536 | A | * | 3/1957 | McQueary | 224/197 |
| 4,662,552 | A | * | 5/1987 | Uyehara | 224/251 |
| 5,167,355 | A | * | 12/1992 | Hill | 224/911 |
| 5,217,151 | A | | 6/1993 | Parsons | |
| 5,449,104 | A | | 9/1995 | Parsons et al. | |
| 5,564,610 | A | * | 10/1996 | Barron | 224/678 |
| 5,588,630 | A | * | 12/1996 | Chen-Chao | 248/514 |
| 5,593,074 | A | * | 1/1997 | Matthews | 224/251 |
| 5,617,980 | A | | 4/1997 | Parsons et al. | |
| 5,839,630 | A | * | 11/1998 | Dunstan et al. | 224/197 |
| 6,059,157 | A | | 5/2000 | Parsons et al. | |
| 6,269,990 | B1 | * | 8/2001 | Gray | 224/200 |
| 6,497,349 | B1 | * | 12/2002 | Ramirez | 224/914 |
| 6,619,521 | B2 | * | 9/2003 | Hadley | 135/16 |

OTHER PUBLICATIONS

Seven (7) digital photographs of product by Monadnock Company. Applicant submits that he was aware of the product more than one year prior to the filing of the above–identified patent application.

* cited by examiner

*Primary Examiner*—Gary E. Elkins
(74) *Attorney, Agent, or Firm*—Welsh & Katz, Ltd.

(57) ABSTRACT

A baton carrier featuring an attachment assembly that is rotatable with respect to the holder portion of the carrier. The baton carrier can be placed in various angular positions with respect to the attachment assembly on the user's belt. The rotatable attachment assembly simplifies the removal of a baton, as well an enhancing comfort for the wearer, by allowing the user to position the carrier at an optimum angle. The baton carrier of the present invention can also accommodate belts of different widths. In one embodiment, the attachment assembly has an adjustable member whose position along the assembly can be changed to allow belts of different widths to be looped therethrough. In another embodiment, one of a plurality of inserts of various sizes may be selected for insertion within the belt loop of the attachment assembly.

43 Claims, 5 Drawing Sheets

100
101
102
103
104
105
106
107
108
109
110
111
112
113
114
115
116
117
118
119
120
121
122
123
124
125
126
127
128
A
B 105
701
8
100
C
113
702
101
112
8

100
105
701
112
122
112
101
106
126

103
100
104
150
150b
150a

103
D
103a
104
103a 200
209
206
203
204
119
207
120
210
202
205
208
201
211
212

200
206
701
213
13
208
301
13

200
206
701

208
206

208

BATON CARRIER

FIELD OF THE INVENTION

This invention relates generally to equipment carriers intended to be worn on the person and in particular to a carrier designed to be worn on the belt of a user, and is more particularly directed toward a belt-suspended carrier that offers rotational adjustment of the body of the carrier with respect to the belt attachment mechanism.

BACKGROUND OF THE INVENTION

Batons are used primarily by law enforcement officers and security personnel. Typically, expandable batons have a cylindrical handle and one or more telescoping cylindrical shafts that can be nested inside the larger handle when the baton is retracted. When an expandable baton is fully extended, it is generally designed to lock in that extended position, and may be retracted by sharply striking the end of the baton with an axial blow.

Batons are available in a range of sizes. In particular, the diameter of the baton handle and the diameter of the telescoping shafts can vary. Usually, a blunt, enlarged tip is located at the outer end of the innermost telescoping shaft of the expanded baton.

Baton carriers, or scabbards, can be designed to be clipped to the belt of a person carrying a baton, and provide a sheath for stowing the baton in a ready position. An effective baton carrier is preferably designed such that a baton cannot be inadvertently released from the carrier, or be taken by an adversary. It is thus important that baton carriers positively secure the baton within the carrier, while at the same time providing for a quick release of the baton should the wearer need to wield it.

Baton carriers are typically attached to a user's belt by looping the belt through a belt clip of the carrier. The width of belts, however, is not standard and varies widely. The variation in belt sizes can prevent a baton carrier from fitting properly onto a user's belt. When disposed on a narrow belt (one that is relatively thin when measured from top to bottom), the baton carrier may have a tendency to slip relative to the belt during use. On the other hand, the width of the belt may be of such a size to prevent it from being looped through the belt clip.

Baton carriers have featured a fixed relationship between the belt securing element and the holder portion of the carrier. The fixed relationship allows the carrier to only be worn on the belt in a vertical orientation. This interferes with a wearer's ability to sit down with a baton in the carrier. To avoid the interference of the baton with the sitting position, a wearer will often remove the baton from the carrier. Removing the baton, of course, makes the baton less ready in an unexpected emergency situation.

SUMMARY OF THE INVENTION

The baton carrier of the present invention, has an attachment assembly that is rotatable with respect to the holder portion of the carrier. Thus, the baton carrier can be placed in various angular positions with respect to the attachment assembly on the user's belt. This rotatable attachment assembly simplifies the removal of a baton, as well an enhancing comfort for the wearer, by allowing the user to position the carrier at an optimum angle.

In addition, the baton carrier of the present invention features an attachment assembly that can accommodate belts of different widths. In one embodiment, the attachment assembly has an adjustable member whose position along the assembly can be changed to allow belts of different widths to be looped therethrough. In another embodiment, one of a plurality of inserts of various sizes may be selected for insertion within the belt loop of the attachment assembly. Thus, the carrier is not limited to use with only one type of belt and is adaptable to provide secure engagement with belts of varying size.

The baton carrier of the present invention also facilitates smooth removal of the baton, and provides a durable, economical, and long-lasting design, by including a unitary spring member within the interior passage of the holder. Although the spring provides friction sufficient to retain the baton within the baton carrier, the interaction between the spring's metallic surface and the handle of the baton facilitates its removal from the carrier. The metallic spring is particularly useful with foam handle batons that provide a great deal of friction. In addition, the spring may be adjusted to accommodate baton handles of varying diameters.

In accordance with one aspect of the present invention, a baton carrier adapted to hold an expandable baton in both extended and retracted positions comprises a baton holder having a substantially cylindrical interior wall defining an interior chamber, and an attachment assembly rotatably coupled to the baton holder, and adapted to removably attach the baton carrier to a belt. Preferably, the baton carrier further comprises a detent mechanism interposed between the attachment assembly and the baton holder.

In one form of the invention, the detent mechanism comprises a radially arranged plurality of detent recesses facing a plurality of similar radially arranged protuberances, such that substantial engagement of the recesses with the protuberances defines one of a predetermined number of operating positions for the attachment assembly with respect to the baton holder. The radially arranged plurality of detent recesses is integrally formed in a back cover assembly attached to the baton holder, and the back cover assembly includes an opening therethrough, the opening centrally disposed within the radially arranged plurality of detent recesses. The plurality of protuberances is integrally formed in the attachment assembly, and the attachment assembly includes a post centrally disposed within the radially arranged plurality of protuberances, such that the opening in the back cover assembly accommodates the post in the attachment assembly to bring the detents and protuberances into facing engagement.

In accordance with another form of the invention, the baton carrier further includes a spring washer having a central opening through which the post extends, the spring washer in contact with the back cover assembly. A fastener having an opening therethrough, with a plurality of engagement tabs circumferentially disposed about, and extending into, the opening, is applied to the post and in contact with the spring washer, fixing the attachment assembly and back cover assembly in rotational engagement, such that the spring washer provides a bias that tends to maintain the facing engagement of the detents and protuberances.

In accordance with yet another form of the invention, the back cover assembly attaches to the baton holder, at least in part, through a tab and slot mechanism, with the tab integrally formed in the back cover assembly and the slot integrally formed in the baton holder. The back cover assembly attaches to a rectangular extension portion of the baton holder, integrally formed therein.

Each of the plurality of detent recesses described above may be substantially trapezoidal in cross-section, with opposing non-parallel sides defining entry angles into the detent recess of between 25 and 45 degrees. Preferably, the entry angle is 35 degrees.

In accordance with still another form of the invention, the substantially cylindrical interior wall includes an elongated opening therein, the opening approximately centrally disposed within the rectangular extension portion of the baton holder. Preferably, a baton securing element extends into the elongated opening. The baton securing element is a spring member having a portion thereof extending into the elongated opening, with at least a part of the spring member retained in position between the back cover assembly and the rectangular extension portion of the baton holder.

In accordance with still a further form of the invention, the attachment assembly includes a loop portion through which a belt passes, the loop portion having an insert that is adjustable in position to accommodate different belt widths. The loop portion includes at least one elongated slot, and at least one screw extends through the slot and into the insert, such that the insert is fixed in position when the screw is tightened, and the insert is movable when the screw is loosened. The insert includes an inner surface, proximate the belt, and the inner surface includes a substantially arcuate region adapted to engage an interior portion of the belt.

In another aspect of the present invention, the radially arranged plurality of detent recesses is integrally formed in a fairing, the fairing integrally formed in and extending outwardly from the baton holder, and the fairing includes an opening therethrough, the opening centrally disposed within the radially arranged plurality of detent recesses. In one form, according to this aspect of the invention, the plurality of protuberances is integrally formed in the attachment assembly, and the attachment assembly includes a post centrally disposed within the radially arranged plurality of protuberances, such that the opening in the fairing accommodates the post in the attachment assembly to bring the detents and protuberances into facing engagement. A spring washer is applied, having a central opening through which the post extends, the spring washer in contact with an interior wall of the fairing.

A fastener having an opening therethrough, with a plurality of engagement tabs circumferentially disposed about, and extending into, the opening, is applied to the post and in contact with the spring washer, fixing the attachment assembly and baton holder in rotational engagement, such that the spring washer provides a bias that tends to maintain the facing engagement of the detents and protuberances.

In another form of the invention, the attachment assembly includes a loop portion through which a belt passes, the loop portion adapted to accept one of a plurality of inserts of varying sizes to accommodate different belt widths. A selected one of the plurality of inserts is removably secured in position by a mating tab and slot arrangement.

Further objects, features, and advantages of the present invention will become apparent from the following description and drawings.

DETAILED DESCRIPTION OF THE INVENTION

Figures 1, 2, 3, 4, 5, 6:
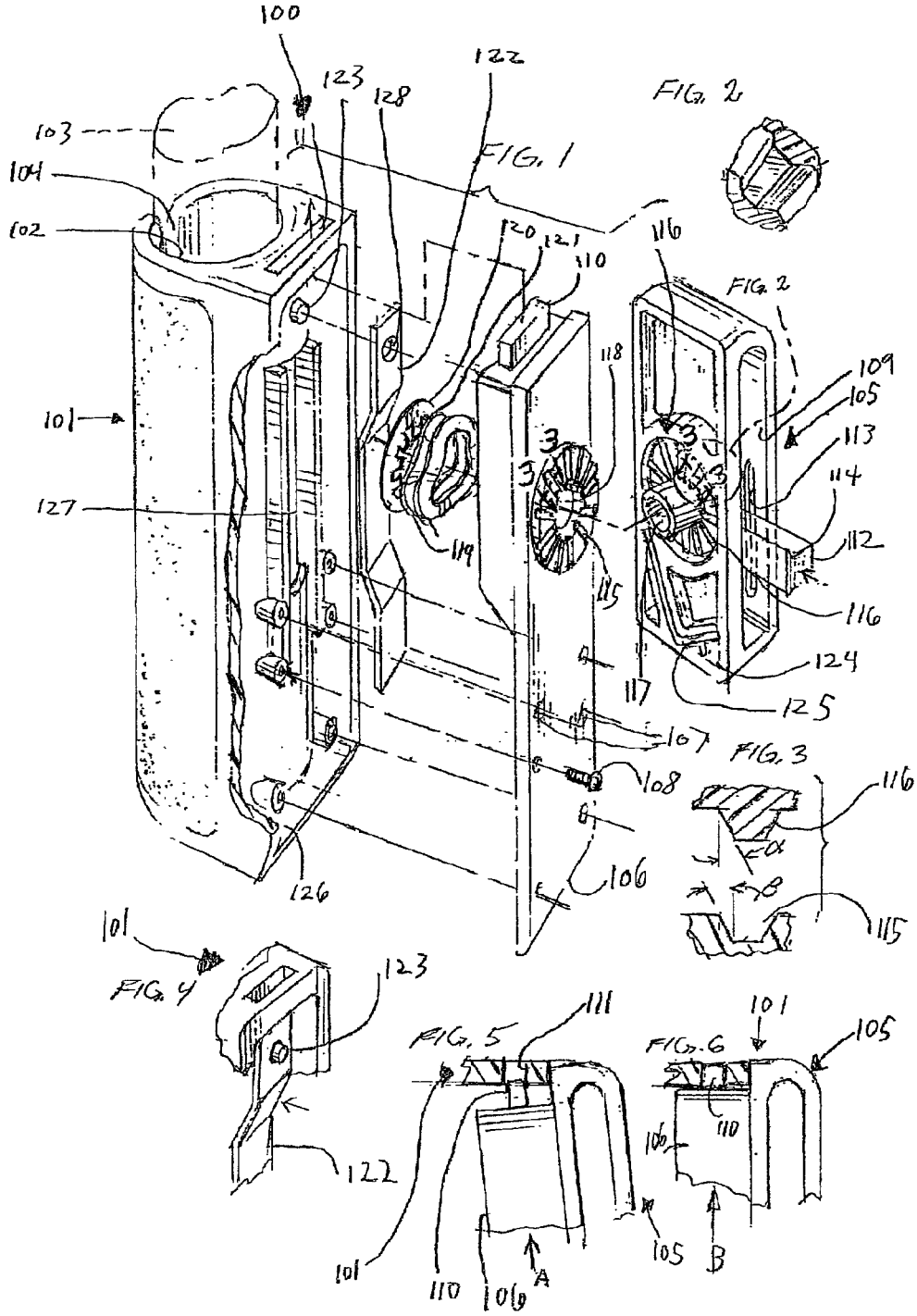
FIG. 1 is an exploded view of one embodiment of a baton carrier in accordance with the present invention.
FIG. 2 is an expanded view of the indicated portion of FIG. 1, illustrating a part of a detent mechanism in greater detail.
FIG. 3 includes a section view taken along section lines 3—3 of FIG. 1 and shows sections of the protuberances and recesses shown in FIG. 1.
FIG. 4 depicts retention of a baton securing element.
FIG. 5 illustrates the beginning of engagement of a back cover assembly.
FIG. 6 shows the back cover assembly of FIG. 5 in final installation position.

There is described herein a baton carrier that offers distinct advantages when compared to the prior art. FIG. 1 is an exploded view of one embodiment of a baton carrier in accordance with the present invention, generally depicted by the numeral 100. The baton carrier 100 includes a baton holder 101 having a substantially cylindrical interior wall 102 that defines an interior chamber or passage in which a baton 103 is placed. The cylindrical wall 102 also features a longitudinal slit or opening 104 that facilitates removal of the baton 103, as will be described in a subsequent paragraph. For a thorough discussion of this feature, and other characteristics of baton carriers of the prior art, reference should be made to the disclosure of U.S. Pat. No. 6,059,157, issued on May 9, 2000, and assigned to the same assignee as the present invention. The specification of U.S. Pat. No. 6,059,157 is hereby fully incorporated by reference thereto, just as though fully set forth herein.

The baton carrier 100 also includes an attachment assembly 105 for attaching the carrier 100 to the belt of a user. It should be noted that any type of baton holder may be effectively combined with this attachment assembly 105, including holders with open or closed sides or bottoms. The attachment assembly 105 is preferably removably affixed to a back cover 106 that includes openings 107 therethrough for receiving screws 108. The attachment assembly 105 further comprises a belt-receiving loop 109.

The back cover 106 includes an integrally formed tab 110 constructed and arranged to mate with a slot 111 integrally formed as part of the baton holder 101. The mating tab 110 and slot 111 arrangement ensures that the back cover 106 and baton holder 101 can be easily and securely attached together.

FIG. 5 indicates how the back cover 106, is engaged with the baton holder 101 to begin installation. The back cover 106 is slowly moved in the direction of arrow A, at a slight angle with respect to the baton holder 101, to bring the tab 110 proximate to and touching the entry end of the slot 111. FIG. 6 depicts the subsequent application of a parallel force, in the direction of arrow B, to ensure that the tab 110 is fully engaged within the slot 111. Installation of the back cover 106 to the baton holder 101 is then completed (FIG. 1) with the addition of the screws 108 through the openings 107 provided.

Figures 7, 8, 9:
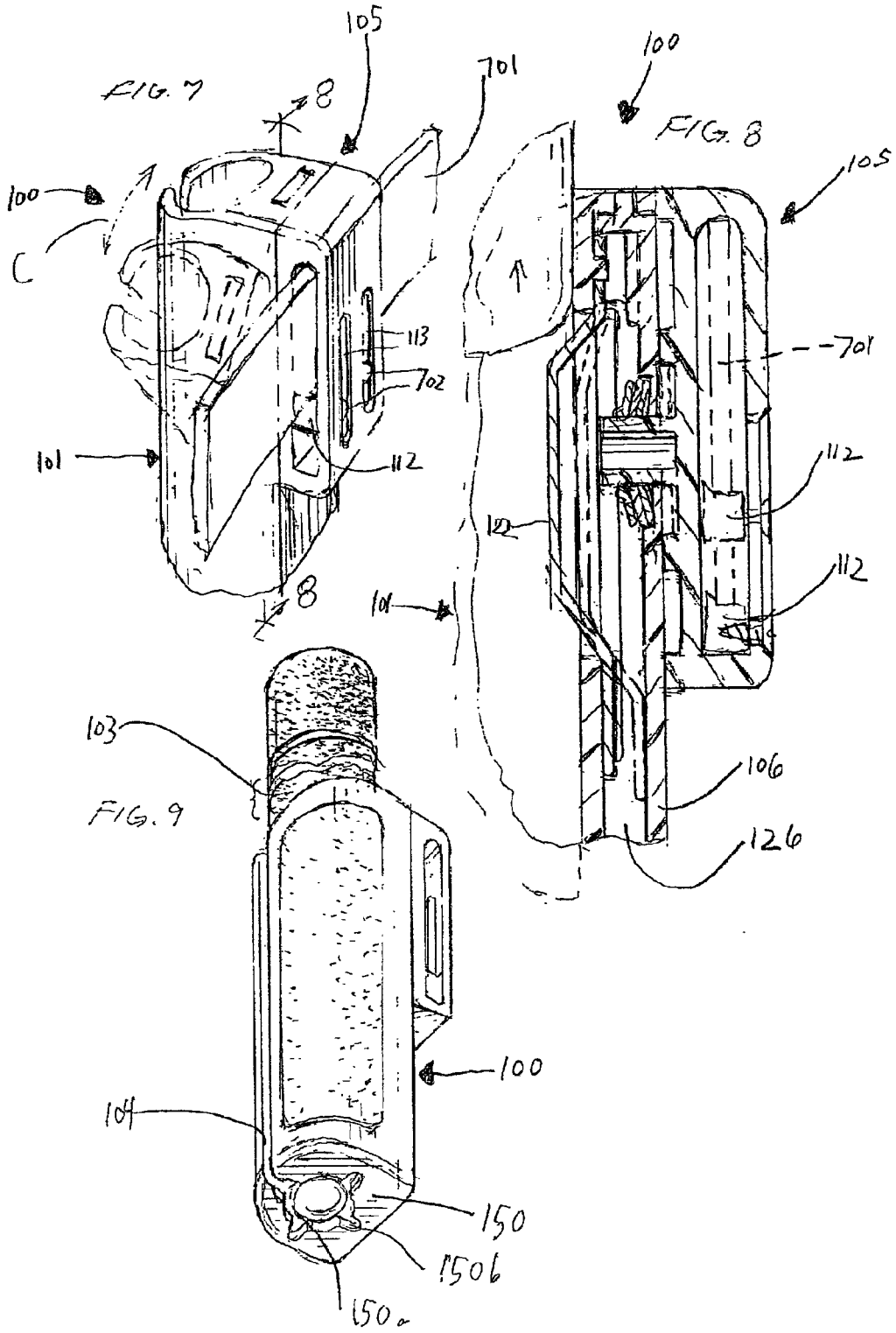
FIG. 7 is a perspective view of the baton carrier of FIG. 1, showing a belt in the loop of the attachment assembly.
FIG. 8 is a section view of the baton carrier of FIG. 7, taken along section lines 8—8.
FIG. 9 depicts the baton in the baton carrier.

To accommodate belts of different widths, the belt-receiving loop 109 is provided with an adjustable insert 112, two slots 113 extending longitudinally along the loop 109, and attachment screws 702 (FIG. 7). The advantage of using a plurality of slots 113 and fasteners 702 to secure the insert 112 is that pivoting of the insert 112 about the screws 702 is avoided and that a greater locking force can be achieved.

Referring to both FIGS. 1 and 7, it will be appreciated that the insert 112 is provided with a substantially curved or arcuate region 114 along an inner surface of the insert 112. This arcuate region 114 forms a lip or extension at an inner extremity of the insert 112, that provides firm engagement with an interior surface of the belt 701 that is inserted through the belt loop 109.

The insert 112 is held in place by the tightening force of the screws 702 against the outer surface of the loop 109. To change the position of the insert 112 along the loop 109, first the screws 702 are loosened from engagement with the slots 113. Then the position of the insert 112 can be adjusted along the length of the slots 113. Once the insert 112 is in a position to accommodate the width of a particular belt 701, the screws 702 are tightened against the slots 113, thereby positioning the insert 112 in the desired position. This ensures a snug fit between the belt 701 and the loop 109, and minimizes slippage. Also, as shown in FIGS. 7 and 8, the screws 702 in the slots 113 extending through the insert 112 are all within the periphery of the loop 109 of the attachment assembly 105 so as not to create an obstruction to other items that may be mounted on the belt 701.

Washers, although not illustrated in the drawings, may be provided on the screws 702 to help ensure a tight fit of the screws 702 against the slots 113 and maintain the tightening force of the screws. For example, number 3 internal tooth lock washers can be used with the screws 702. Preferably, although not required, when such washers are used, they are first placed on the screws 702 during manufacture, following which threading is added to the screws 702. This prevents the washer and the screw from being separated, and guarantees that any benefit provided by the washer in terms of tightness is not lost.

The present invention has a further advantage in that the attachment assembly 105 and the baton holder 101 are rotatable with respect to each other. To enable this feature, a detent mechanism is provided between the attachment assembly 105 and the baton holder 101. Specifically, a radially arranged plurality of detent recesses 115 is integrally formed in an exterior surface of the back cover 106, while a radially arranged plurality of protuberances 116 is integrally formed on a facing surface of the attachment assembly 105. As can be appreciated from an examination of FIG. 1, substantial facing engagement of the plurality of recesses 115 with the plurality of protuberances 116 defines one of a plurality of angular operating positions of the attachment assembly 105 with respect to the back cover 106.

FIG. 2 represents a close-up view of a protuberance or tab integrally formed in the attachment assembly 105.

FIG. 3, which illustrates one protuberance and a recess in section view, clearly reflects the trapezoidal nature of the protuberances and recesses.

As FIG. 3 shows, the non-parallel opposing side walls of the protuberances make an angle a with the plane of the surface in which they appear. These angles are entry and departure angles for the mating recesses. The recesses make an angle beta as shown. It has been determined that an angle of between about 25 degrees and 45 degrees is optimum for both entry and departure angles. In the preferred form of the invention, the entry and departure angles are both about 35 degrees.

To secure the attachment assembly 105 and the back cover 106 together, and to ensure proper facing engagement of the plurality of protuberances 116 and recesses 115, a post 117 is integrally formed in the attachment assembly 105, centrally disposed within the radially arranged protuberances 116. An opening 118 is provided in the back cover 106, once again centrally disposed with respect to the radially arranged plurality of recesses 115. The post 117 is inserted through the opening 118, and a spring washer or wave washer 119, preferably formed from spring steel, is applied over the post 117, and in contact with an interior surface of the back cover 106. To ensure a proper bias that will maintain adequate operational facing engagement of the protuberances 116 and recesses 115, two wave washers 119 may be used.

After application of the wave washer 119, a fastener or retaining ring 120 is then placed onto the post 117, in contact with the wave washer 119. The fastener 120 functions to keep the attachment assembly 105 and the back cover 106 together, in rotational relationship. The fastener 120 features a plurality of tabs 121 arranged around the interior circumference of the opening in the fastener 120, and extending into the opening. These tabs 121 grip the outer surface of the post 117 when the fastener 120 is installed, and make fastener 120 removal difficult. An example of a suitable fastener 120 is a reinforced circular push-on external retaining ring commercially available from Truarc Manufacturing Co.

Preferably, when the protuberances 116 and recesses 115 are maintained in facing engagement, there are twelve stable operating positions created in which the protuberances 116 nest within the mating recesses 115. The baton holder 101 may be rotated with respect to the attachment assembly 105 about circular arc C, as shown in FIG. 7. The two rotatably coupled parts then "snap" into stable operating positions every time the protuberances firmly engage the mating recesses. The twelve operating positions come about because the tabs and protuberances are preferably radially arranged to occur every thirty degrees. Of course, other angular spacings are also possible, and it is not necessary that the protuberances and tabs be uniformly distributed.

As a matter of convenience for the user, an inner facing surface 124 of the attachment assembly 105 may include a recess shaped to store a hex key 125 or other tool that can be exposed upon rotation. As can be appreciated from FIG. 1, the hex key 125 can be accessed by rotating the attachment assembly 105 with respect to the back cover 106. Thus, the hex key 125 is available to the user for disassembly of the baton carrier 100, or for adjustment of the insert 112 to accommodate the wearer's belt 701 (FIG. 7).

In practice, a raised, rectangular extension portion 126 is integrally formed in the baton holder 101. The interior of this rectangular extension 126 accommodate the wave washers 119 and fastener 120 that hold carrier 100 together. In addition, an elongated, preferably rectangular opening 127 is formed in the interior wall of the holder 101. This opening 127 is designed to accommodate a spring plate or baton securing element 122 that is intended to engage a baton 103 that has been inserted into the holder 101. Preferably, the baton securing element 122 is an elongate spring plate that is suitably bent for the purpose, and including an opening 128 disposed near one end. As can be seen in FIG. 4, the opening 128 engages a post 123 that is integrally formed in the holder 101. The baton securing element 122 is thus retained in a desired position, extending into the opening 127 in the holder 101. FIG. 8 illustrates, in section view, the final positions of the various components of the baton carrier 100 after assembly.

With baton carriers of the prior art, a baton must be pulled upwardly from the carrier to axially withdraw the baton therefrom. This upward motion is perpendicular to the user's belt and is made with the hand of the user that is on the same side of the body as the carrier is mounted. Alternately, the baton can be withdrawn from the carrier using the opposite hand with a motion across the body. The attachment assembly 105, with its rotational mounting with respect to the holder 101 of the present invention, avoids such awkward movements. The ability to place the baton carrier 100 in various angular positions facilitates removal of the baton 103 therefrom. For example, a baton in a holder that has been rotated forward to a 60° angle with respect to the vertical is easily removed by a cross-arm motion.

The baton holder 101 has an opening 150 to allow an extended portion of the baton to protrude through end wall 150. Allowing for the extended portion of the baton to protrude through end wall 150 allows a user to store the baton in the extended position. Slots 150*b* in the end wall 150 allow for opening 150*a* to expand to receive an extended portion of the baton 103*a*. See FIG. 10.

Figure 10:
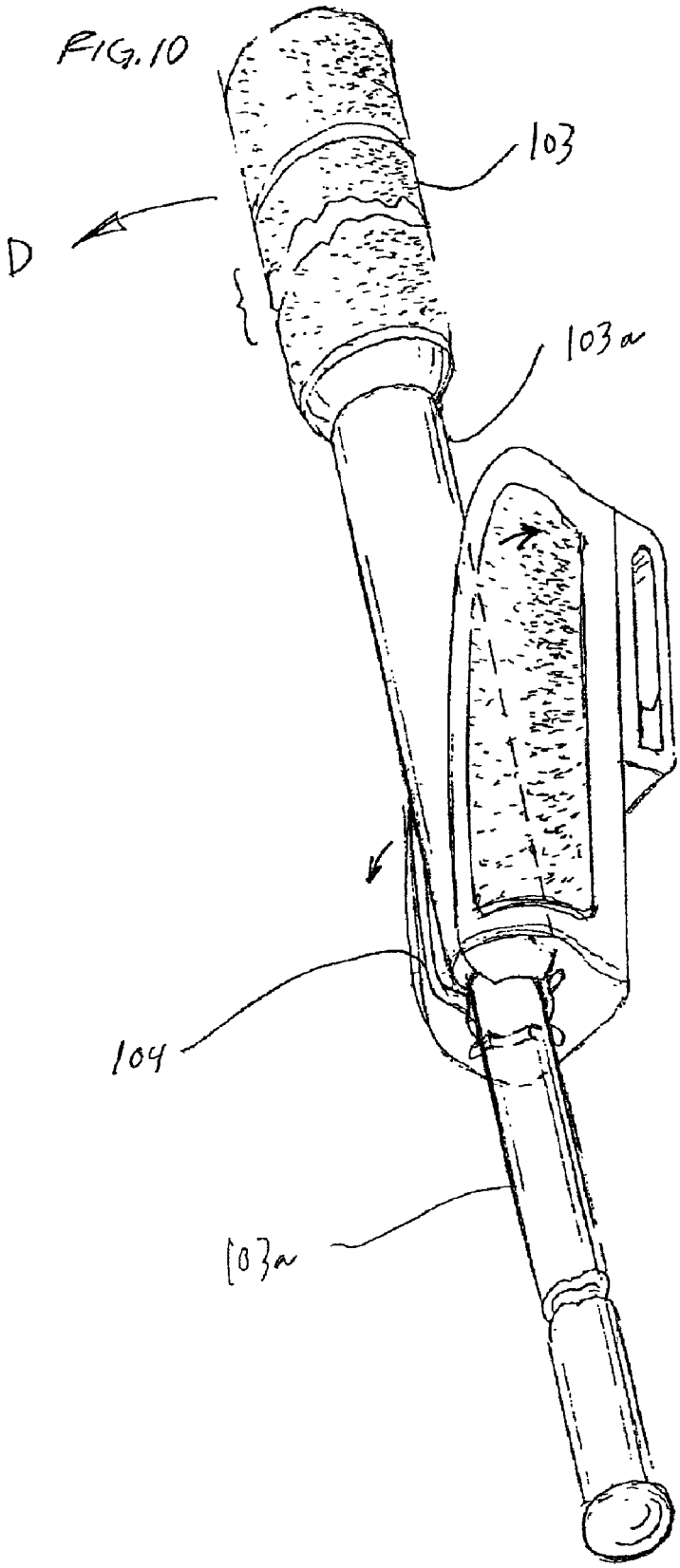
FIG. 10 depicts one technique of releasing the baton from the baton holder when the baton is in an extended position.

Of course, the baton holder 101 of the present invention is equipped with a longitudinal slot 104 that is integrally formed in the exterior wall of the holder 101. As shown in FIG. 10, the slot 104 enables flexibility of the baton holder allowing the user to remove the baton 103 from the holder 101 quickly, even if the user applies some lateral force as indicated by the arrow D. The longitudinal slot allows lateral removal of the baton in direction D when the baton is in a fully extended position. The baton holder has enough flexibility to allow an extended portion of the baton 103*a* to work through slot 104. See FIG. 10. The holder 101 is formed from a durable yet flexible material that allows such side extraction repeatedly without damage. Preferably, the holder is formed by injection molding a suitably durable plastic. The attachment assembly 105 and back cover 106 may also be injection molded using similar material.

Figure 11:
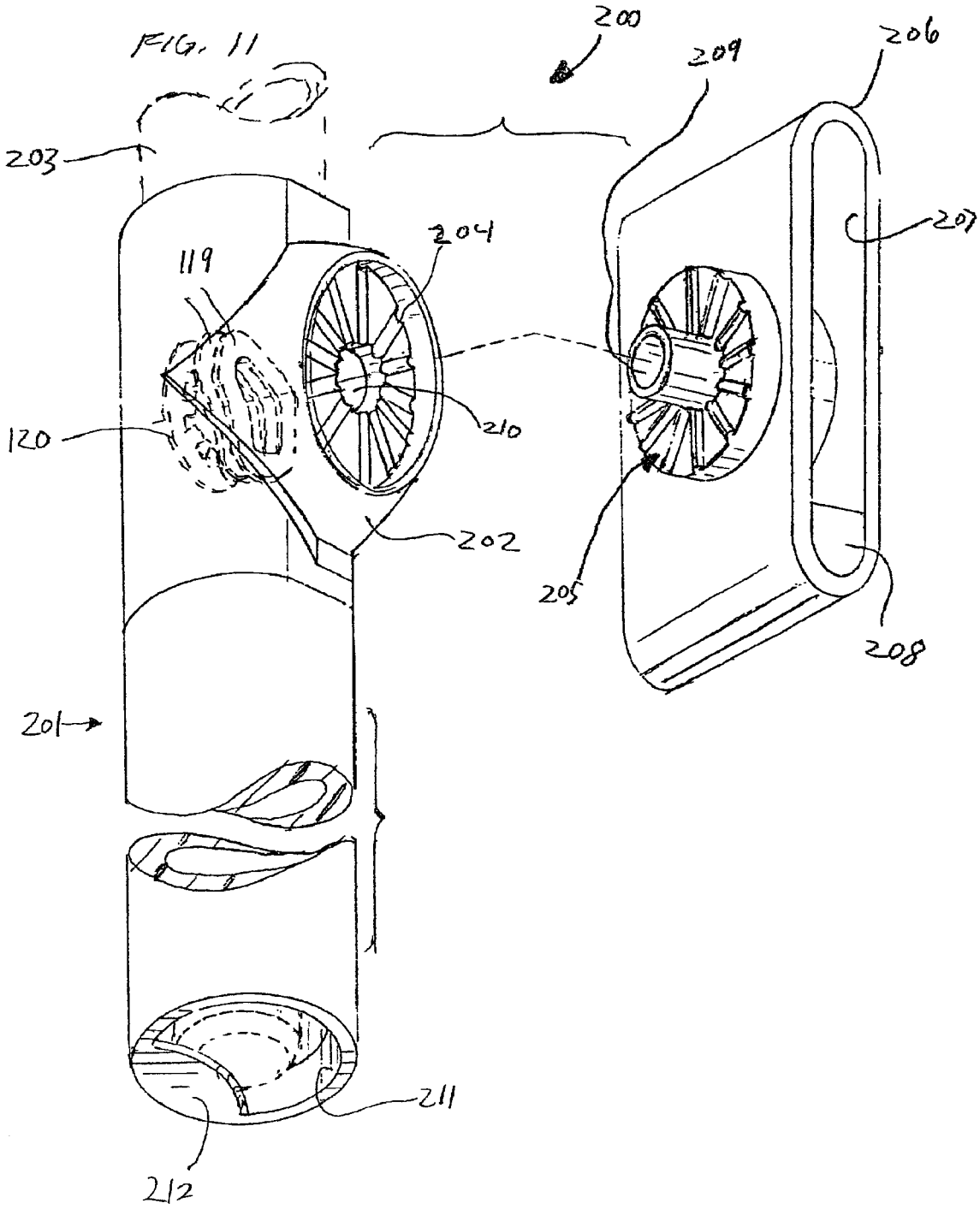
FIG. 11 is an exploded view of an alternative embodiment of a baton carrier in accordance with the present invention.

FIG. 11 illustrates an alternative embodiment of the baton carrier of the present invention, generally depicted by the numeral 200. In this form of the invention, a fairing 202 is integrally formed in the holder 201. The interior portion of the fairing provides space for the wave washers 119 and fastener 120 as described above. In fact, operation of this alternative embodiment is substantially identical to that described previously, with a radially arranged plurality of protuberances 205 on an attachment assembly 206 brought into facing engagement with a radially arranged plurality of recesses 204. A post 209 is integrally formed in the attachment assembly 206, and is inserted through an opening 210 integrally formed in the holder 201. With the wave washers 119 installed just as described above with respect to the first described embodiment of the invention, the protuberances 205 and recesses 204 are urged into facing engagement to create a plurality of stable operating positions, rotationally distinct from one another. Preferably, twelve such stable operating positions are created by arranging each of the tabs and protuberances 30 degrees apart from one another.

The embodiment illustrated in FIG. 11 has an opening 211 at the bottom of the baton holder 201 that is partially closed by an integrally formed plastic tab 212 that extends into the opening 211. This configuration permits insertion of a baton 203 in either its retracted or extended condition without difficulty. The baton carrier 200 may also be manufactured by injection molding plastic of suitable strength and durability.

Figures 12, 13, 14, 15:
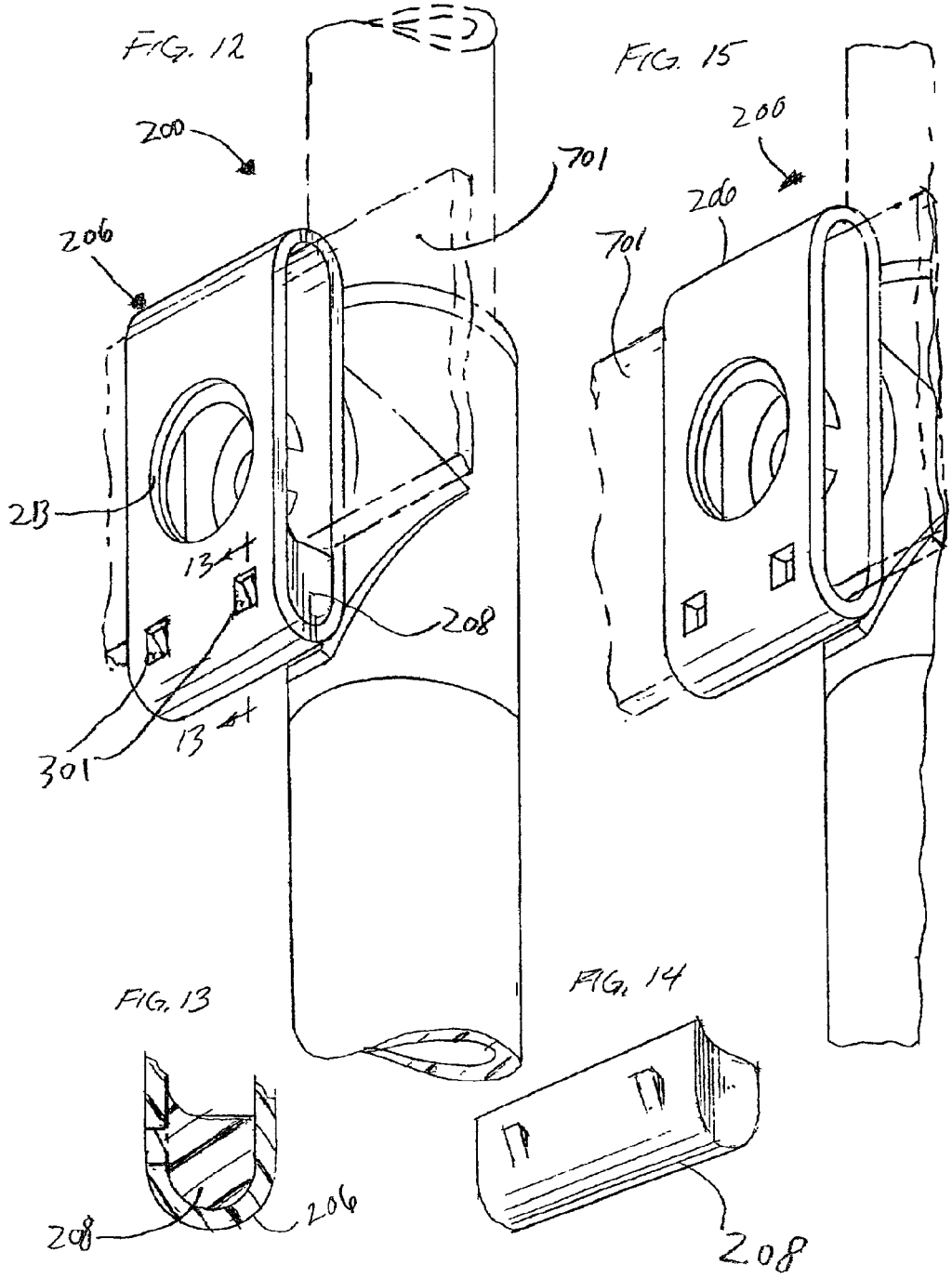
FIG. 12 illustrates the baton carrier of FIG. 10, with a relatively narrow belt inserted through the loop of the attachment assembly.
FIG. 13 is a close-up sectional view of the belt loop and insert of the baton carrier of FIG. 12. taken along section lines 13—13.
FIG. 14 is a side perspective view of the insert for the belt loop of the baton carrier shown in FIG. 12.
FIG. 15 is a partial view of the baton carrier of FIG. 10, showing a wider belt inserted through the loop of the attachment assembly.

The attachment assembly 206 of the alternative embodiment provides an alternative method for suspending the baton carrier 200 from the belt of a user. A loop 207 is integrally formed in the attachment assembly through which a belt 701 may be inserted (FIG. 12). An insert 208 of suitable size is positioned within the loop 207. Unlike the insert described above in conjunction with the first embodiment, this insert 208 is merely one of a plurality of inserts of various widths.

The insert 208 includes tabs integrally formed on its outer surface. The tabs are generally triangular in shape and are disposed such that the departure angle at the end of the tab nearer the users belt is approximately 90 degrees, while the departure angle at the other end of the tab is an acute angle, preferably about 30 degrees. For installation, the insert 208 is placed within the loop 207, then is simply slid downward toward a pair of slots 301 integrally formed in the attachment assembly 206. The tabs engage the slots 301, snapping into place. Preferably, the attachment assembly is formed from a flexible material, more easily to allow installation and removal of different inserts 208. In addition, an opening 213 is integrally formed within the attachment assembly 206 to enhance its flexibility.

There has been described herein a baton carrier that offers distinct advantages when compared with the prior art. It will be apparent to those skilled in the art that modifications may be made without departing from the spirit and scope of the invention. Accordingly, it is not intended that the invention be limited except as may be necessary in view of the appended claims.

What is claimed is:

1. A baton carrier adapted to hold a baton, the baton carrier comprising: a baton holder having an at least partially cylindrical interior wall defining an interior chamber and a back wall; an attachment assembly rotatably coupled to the baton holder, and adapted to removably attach the baton carrier to a belt, a detent mechanism interposed between the attachment assembly and the baton holder and comprising a recess carrying structure having a radial arrangement of a plurality of detent recesses facing a plurality of similar radially arranged protuberances on a protuberance structure, such that substantial engagement of the recesses with the protuberances defines one of a predetermined number of operating positions for the attachment assembly with respect to the baton holder and a spring mechanism associated with the detent mechanism for urging the protuberances toward the detent recesses releasably to lock the baton holder in one position on the baton carrier while permitting relative movement between the recess carrying structure and the protuberance structure from one releasably locked position to another releasably locked position.

2. The baton carrier of claim 1, wherein the radially arranged plurality of detent recesses is integrally formed in a back cover assembly which defines said recess carrying structure and which is attached to the baton holder, and wherein the back cover assembly includes an opening therethrough, the opening centrally disposed within the radially arranged plurality of detent recesses.

3. The baton carrier of claim 1, wherein the plurality of protuberances is integrally formed in the attachment assembly which defines said protuberance structure, and wherein the attachment assembly includes a post centrally disposed within the radially arranged plurality of protuberances, such that the opening in the back cover assembly accommodates the post in the attachment assembly to bring the detent recesses and protuberances into facing engagement.

4. The baton carrier of claim 3, wherein said spring mechanism includes, at least in part, a spring washer having a central opening through which the post extends, the spring washer in contact with the back cover assembly.

5. The baton carrier of claim 4, further comprising a fastener having an opening therethrough, with a plurality of engagement tabs circumferentially disposed about, and extending into, said opening, the fastener applied to the post and in contact with the spring washer, fixing the attachment assembly and back cover assembly in rotational engagement, such that the spring washer provides a bias that tends to maintain the facing engagement of the detent recesses and protuberances.

6. The baton carrier of claim 2, wherein the back cover assembly attaches to the baton holder, at least in part, through a tab and slot mechanism, with the tab integrally formed in the back cover assembly and the slot integrally farmed in the baton holder.

7. The baton carrier of claim 2, wherein the back cover assembly attaches to said back wall of the baton holder.

8. The baton carrier of claim 1, wherein each of the plurality of detent recesses is substantially trapezoidal in cross-section, sides defining entry angles between 25 and 45 degrees.

9. The baton carrier of claim 1, wherein the entry angles are 35 degrees.

10. The baton carrier of claim 1, wherein the back wall has an elongated opening therein, the opening being approximately centrally disposed within the back wall of the baton holder.

11. The baton carrier of claim 10, further comprising a baton securing element extending into the elongated opening.

12. The baton carrier of claim 11, wherein the baton securing element is a spring member having a portion thereof extending from said baton carrier into said elongated opening, with at least a part of the spring member being retained in position between a back cover assembly for the baton holder and the rectangular back wall of the baton holder.

13. The baton carrier of claim 1 wherein the radially arranged plurality of detent recesses is integrally formed in a fairing defining said recess carrying structure, the fairing integrally formed in and extending outwardly from the baton holder, and wherein the fairing includes an opening therethrough, the opening centrally disposed within the radially arranged plurality of detent recesses.

14. The baton carrier of claim 13, wherein the plurality of protuberances is integrally formed in the attachment assembly which defines said protuberance structure and wherein the attachment assembly includes a post centrally disposed within the radially arranged plurality of protuberances, such that the opening in the fairing accommodates the post in the attachment assembly to bring the protuberances and detent recesses into facing engagement.

15. The baton carrier of claim 14, further including a spring washer having a central opening through which the post extends, the spring washer being in contact with an interior wall of the fairing and forming at least part of said spring mechanism.

16. The baton carrier of claim 15, further comprising a fastener having an opening therethrough, with a plurality of engagement tabs circumferentially disposed about, and extending into, said opening, the fastener applied to the post and in contact with the spring washer, fixing the attachment assembly and baton holder in rotational engagement, such that the spring washer provides a bias that tends to maintain the facing engagement of the detent recesses and protuberances.

17. The baton carrier of claim 16, wherein the attachment assembly includes a loop portion through which a belt passes, the loop portion adapted to accept one of a plurality of inserts of varying sizes to accommodate different belt widths.

18. The baton carrier of claim 17, wherein a selected one of the plurality of inserts is removably secured in position by a mating tab and slot arrangement.

19. The baton carrier of claim 18, wherein at least one slot is provided in the loop portion of the attachment assembly, and the selected insert includes at least one tab, generally triangular in configuration, extending outwardly therefrom.

20. The baton carrier of claim 19, wherein the generally triangular tab makes an acute angle within outer surface of the insert at a first departure end, and makes a right angle with an outer surface of the insert at a second departure end.

21. The baton carrier of claim 20, wherein the insert includes an inner surface, proximate the belt, and the inner surface includes a substantially arcuate region adapted to engage an interior portion of the belt.

22. The baton carrier of claim 21, wherein the first departure end of the tab is distal from the inner surface of the insert, while the second departure end is proximate the inner surface, such that the insert is moved away from the belt, within the loop portion, to engage in insert and secure the insert in position.

23. The baton carrier of claim 1 including a spring member mounted at one end to or connected at one end to said baton carrier and having at least a portion thereof which extends through an opening in said at least partially cylindrical wall of said baton carrier into said interior chamber for engaging and holding in place a baton received in said interior chamber.

24. The baton carrier of claim 1 wherein said spring mechanism includes at least one spring washer which bears against said recess carrying structure.

25. The baton carrier of claim 1 including a back cover for said baton holder, said back cover defining said recess carrying structure and having an opening there-through, said detent recesses being radially arranged around said opening, said attachment assembly defining said protuberance structure and including a post which extends through said opening and said spring mechanism, includes at least one spring-wave washer located between said baton holder and said back cover and received over said post.

26. A baton carrier adapted to hold a baton, the baton carrier comprising: a baton holder having an at least partially cylindrical interior wall defining an interior chamber, and an attachment assembly rotatably coupled to the baton holder, adapted to removably attach the baton carrier to a belt and including a loop portion having an outer periphery and through which a belt passes, the loop portion having an insert that is adjustable in position to accommodate different belt widths and a structure and mechanism within the outer periphery of said loop portion for releasably locking said insert in place without any of said structure and mechanism extending beyond the outer periphery of said loop portion.

27. A baton carrier adapted to hold an expandable baton in both extended and retracted positions, the baton carrier comprising: a baton holder having an at least partially cylindrical interior wall defining an interior chamber; and an attachment assembly rotatably coupled to the baton holder, adapted to removably attach the baton carrier to a belt and including a loop portion through which a belt passes, the loop portion having an insert that is adjustable in position to accommodate different belt widths and having at least one elongated slot, and wherein at least one screw extends through the slot and into the insert, such that the insert is fixed in position when the screw is tightened, and the insert is movable when the screw is loosened.

28. The baton carrier of claim 27, wherein the insert includes an inner surface, proximate the belt, and the inner surface includes a substantially arcuate region adapted to engage an interior portion of the belt.

29. A baton carrier adapted to hold a baton, the baton carrier comprising:

a baton holder having an at least partially cylindrical interior wall defining an interior chamber;

an attachment assembly rotatably coupled to the baton holder, and adapted to removably attach the baton carrier to a belt;

a back cover assembly for said baton holder; and a detent mechanism interposed between the attachment assembly and said back cover assembly of the baton holder, said back cover having a radial arrangement of a plurality of detent recesses facing a plurality of similar radially arranged protuberances on said attachment assembly, such that substantial engagement of the detent recesses with the protuberances defines one of a predetermined number of operating positions for the attachment assembly with respect to the baton holder and a spring arranged to bear against one of said back cover assembly or said attachment assembly for urging said protuberances toward said detent recesses releasably to lock the baton holder in one position on the baton carrier while permitting relative movement between said back cover assembly and said attachment assembly from one releasably locked position to another releasably locked position.

30. The baton carrier of claim 29, wherein the back cover assembly includes an opening therethrough, the opening centrally disposed within the radially arranged plurality of detent recesses.

31. The baton carrier of claim 30, wherein the attachment assembly includes a post centrally disposed within the radially arranged plurality of protuberances, such that the opening in the back cover assembly accommodates the post in the attachment assembly to bring the detent recesses and protuberances into facing engagement.

32. The baton carrier of claim 31, wherein said spring includes a spring washer having a central opening through which the post extends, the spring washer being in contact with the back cover assembly.

33. The baton carrier of claim 32, further comprising a fastener having an opening therethrough, with a plurality of engagement tabs circumferentially disposed about, and extending into, said opening, the fastener applied to the post and in contact with the spring washer, fixing the attachment assembly and back cover assembly in rotational engagement, such that the spring washer provides a bias that tends to maintain the facing engagement of the detent recesses and protuberances.

34. The baton carrier of claim 30, wherein the back cover assembly attaches to the baton holder, at least in part, through a tab and slot mechanism, with the tab integrally formed in the back cover assembly and the slot integrally formed in the baton holder.

35. The baton carrier of claim 29, wherein the radially arranged plurality of detent recesses is integrally formed in a fairing, the fairing integrally formed in and extending outwardly from the baton holder, and wherein the fairing includes an opening therethrough, the opening centrally disposed arranged plurality of detent recesses.

36. The baton carrier of claim 35, wherein the attachment assembly includes a post centrally disposed within the radially arranged plurality of protuberances, such that the opening in the fairing accommodates the post in the attachment assembly to bring the detent recesses and protuberances into facing engagement.

37. The baton carrier of claim 36, further comprising a fastener having an opening therethrough, with a plurality of engagement tabs circumferentially disposed about, and extending into, said opening, the fastener applied to the post and in contact with the spring washer, fixing the attachment assembly and baton holder in rotational engagement, such that the spring washer provides a bias that tends to maintain the facing engagement of the detents and protuberances.

38. The baton carrier of claim 37, wherein the attachment assembly includes a loop portion through which a belt passes, the loop portion adapted to accept one of a plurality of inserts of varying sizes to accommodate different belt widths.

39. A baton carrier adapted to hold a baton, said baton carrier comprising: a baton holder having an at least partially cylindrical interior wall defining an interior chamber and a back wall; an attachment assembly coupled to said back wall of said baton holder and adapted to removably attach said baton carrier to a belt and including a loop portion through which a belt passes, and a spring member extending in cantilever fashion from said baton carrier and having at least a portion thereof extending through an opening in said back wall of said baton holder and into said interior chamber.

40. The baton carrier of claim 39, wherein said opening therein, said elongate opening is elongate and is approximately centrally disposed within said back wall of said baton holder and at least a portion of said spring member extends through said elongate opening for engaging and releasably securing a baton in said interior chamber.

41. The baton carrier of claim 39, wherein said portion of said spring member which extends into said interior chamber is arranged and positioned to engage and releasably hold in place, a baton received in said interior chamber.

42. The baton carrier of claim 39, wherein said spring member is a bent spring that is fixed at one end to said baton carrier and which extends through said opening in said back wall of said baton holder into said interior chamber for engaging and releasably securing a baton received in said interior chamber of said baton holder.

43. The baton carrier of claim 42, wherein a central offset portion of said bent spring extends through said opening in said back wall for releasably securing a baton in said interior chamber.

* * * * *